US007108363B2

(12) United States Patent
Jones et al.

(10) Patent No.: US 7,108,363 B2
(45) Date of Patent: Sep. 19, 2006

(54) KEYING ELEMENTS FOR SOLID INK LOADER

(75) Inventors: Brent R. Jones, Tualatin, OR (US); Timothy L. Crawford, Saint Paul, OR (US)

(73) Assignee: Xerox Corporation, Stamford, CT (US)

( * ) Notice: Subject to any disclaimer, the term of this patent is extended or adjusted under 35 U.S.C. 154(b) by 267 days.

(21) Appl. No.: 10/835,133

(22) Filed: Apr. 29, 2004

(65) Prior Publication Data

US 2004/0201651 A1 Oct. 14, 2004

Related U.S. Application Data

(63) Continuation-in-part of application No. 10/159,424, filed on May 30, 2002.

(51) Int. Cl.
*B41J 2/175* (2006.01)

(52) U.S. Cl. ..... 347/88; 347/84

(58) Field of Classification Search ..... 347/84, 347/85, 88, 99, 95

See application file for complete search history.

(56) References Cited

U.S. PATENT DOCUMENTS

| | | | | |
|---|---|---|---|---|
| 5,734,402 | A | 3/1998 | Rousseau et al. | 347/88 |
| 5,861,903 | A | 1/1999 | Crawford et al. | 347/88 |
| 6,053,608 | A | 4/2000 | Ishii et al. | 347/88 |
| 6,056,394 | A * | 5/2000 | Rousseau et al. | 347/88 |
| 6,543,867 | B1 | 4/2003 | Jones | 347/7 |
| 6,561,636 | B1 | 5/2003 | Jones | 347/88 |
| 6,565,200 | B1 | 5/2003 | Jones | 347/88 |
| 6,565,201 | B1 | 5/2003 | Jones | 347/88 |
| 6,572,225 | B1 | 6/2003 | Jones | 347/88 |
| 6,648,435 | B1 | 11/2003 | Jones | 347/7 |
| 6,679,592 | B1 | 1/2004 | Casserino et al. | 347/85 |
| 6,705,710 | B1 | 3/2004 | Jones et al. | 347/84 |
| 6,709,094 | B1 | 3/2004 | Jones | 347/88 |
| 6,719,413 | B1 | 4/2004 | Jones | 347/84 |

* cited by examiner

*Primary Examiner*—Juanita D. Stephens
(74) *Attorney, Agent, or Firm*—Joseph M. Young

(57) ABSTRACT

An insertion element that connects to an ink stick receptacle in a key plate, wherein the insertion element forms at least one edge of an insertion opening, and wherein the insertion element is shaped to complement at least a portion of the perimeter of an ink stick. The element is used in a solid ink loader, which includes at least one feed channel for receiving ink sticks and at least one key plate for covering the at least one feed channel. The at least one key plate includes a receptacle for the insertion opening surround element.

20 Claims, 15 Drawing Sheets

KEYING ELEMENTS FOR SOLID INK LOADER

This application is a continuation-in-part of U.S. patent application Ser. No. 10/159,424, filed May 30, 2002.

Solid ink jet printers were first offered commercially in the mid-1980's. One of the first such printers was offered by Howtek Inc. which used pellets of colored cyan, yellow, magenta and black ink that were fed into shape coded openings. These openings fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate rounded, five, six, and seven sided shapes each corresponding to a particular color.

Later solid ink printers, such as the Tektronix "Phaser"™, the Tektronix "Phaser 300"™, and the "Jolt"™ printer offered by Dataproducts Corporation, used differently shaped solid ink sticks that were either gravity fed or spring loaded into a feed channel and pressed against a heater plate to melt the solid ink into its liquid form. These ink sticks were shape coded and of a generally small size. One system used an ink stick loading system that initially fed the ink sticks into a preload chamber and then loaded the sticks into a load chamber by the action of a transfer lever. Earlier solid or hot melt ink systems used a flexible web of hot melt ink that is incrementally unwound and advanced to a heater location or vibratory delivery of particulate hot melt ink to the melt chamber.

Basic configurations of a four-color ink loader having independent melt plates have been described in previously issued patents such as, for example, U.S. Pat. Nos. 5,734,402, 5,861,903, and 6,056,394. The disclosures of these patents are hereby incorporated by reference in their entirety.

To further enhance ink stick loaders, such as that disclosed in U.S. Pat. No. 6,561,636, partial surround elements are included that may be used individually or in combination with other partial elements to create a keyed insertion opening for ink sticks.

Embodiments include an insertion element that connects to an ink stick receptacle in a key plate, wherein the insertion element forms at least one edge of an insertion opening, and wherein the insertion element is shaped to complement at least a portion of the perimeter of an ink stick. The element is used in a solid ink loader, which includes at least one feed channel for receiving ink sticks and at least one key plate for covering the at least one feed channel. The at least one key plate includes a receptacle for the insertion opening surround element.

The invention will be described in detail herein with reference to the following figures in which like reference numerals denote like elements and wherein.

Figure 1:
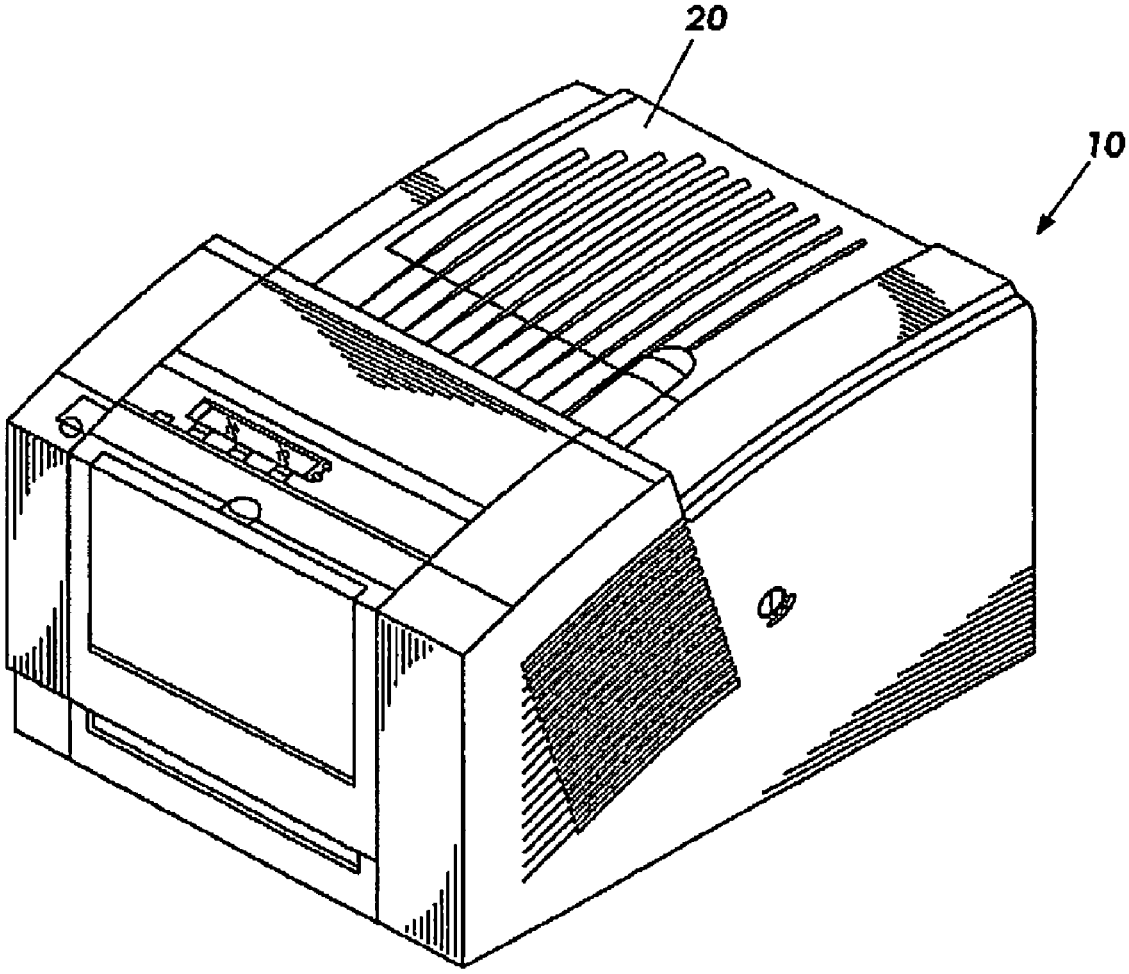
FIG. 1 is a perspective view of an exemplary embodiment of a color printer with the printer top cover closed.
Figure 2A:
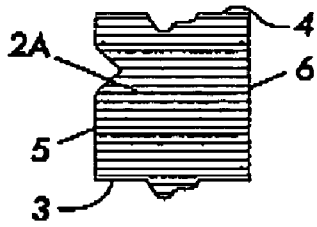
FIG. 2 illustrates a top view of an exemplary embodiment of a set of ink sticks.
Figure 2B:
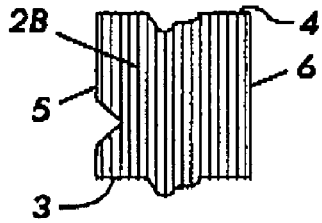
Figure 2C:
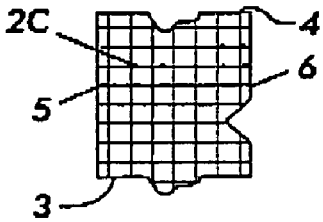
Figure 2D:
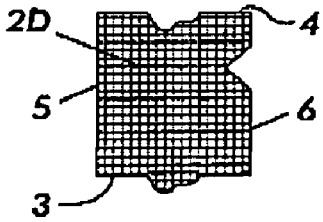

FIG. 1 discloses an embodiment of a solid ink or phase change printer 10 having an ink access cover 20. The ink access cover 20 is shown in a closed position in FIG. 1.

Figure 3:
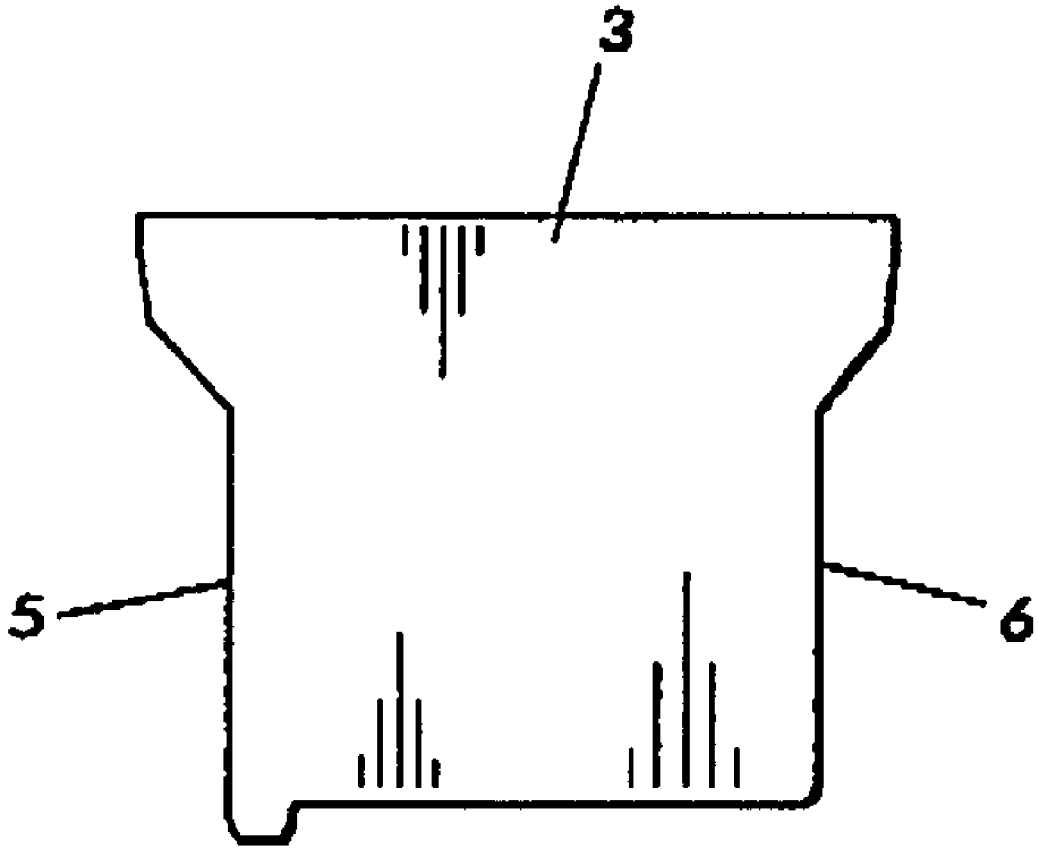
FIG. 3 illustrates a front view of an exemplary embodiment of one of the ink sticks of FIG. 2.
Figure 4:
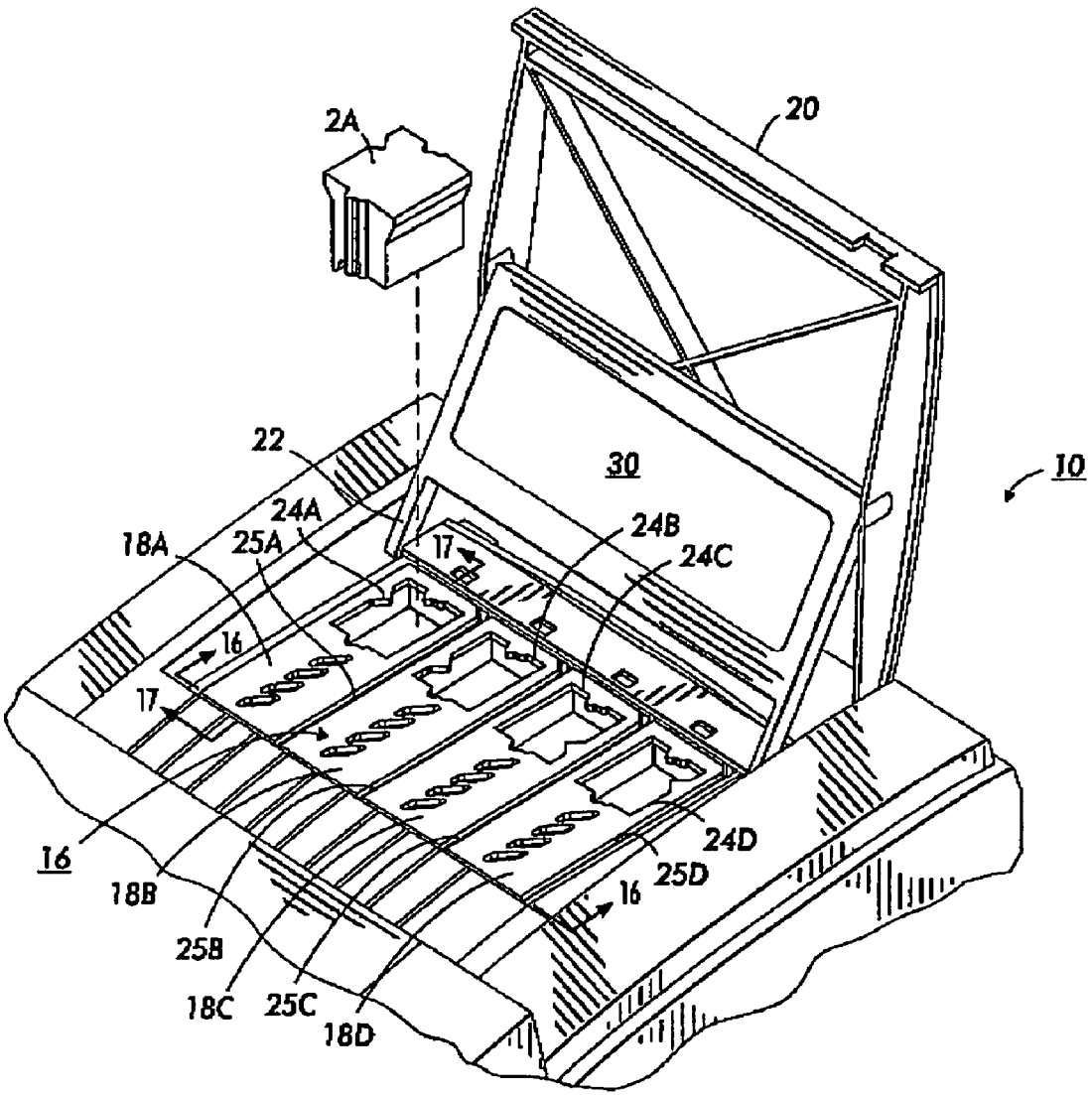
FIG. 4 is an enlarged partial top perspective view of the printer of FIG. 1 with the ink access cover open showing a solid ink stick in position to be loaded into the appropriate ink stick receptacle.

FIGS. 2 and 3 illustrate embodiments of ink sticks for use with an ink loader, such as, for example, that shown in FIG. 4. As will be noted repeatedly during the description of embodiments, the exact configuration of the ink sticks disclosed herein is not important either to the ink loader disclosed herein, or to specific components thereof. However, a description of general features of the ink sticks is useful for a better understanding of the disclosed embodiments of an ink loader.

Solid ink sticks 2 are used in phase change ink jet printers such as the printer 10 shown in FIG. 1. In embodiments, the ink sticks have a generally top portion, which can be a substantially horizontal top surface, and a generally bottom portion, which can be a substantially horizontal bottom surface. Side surfaces connect the top and bottom of the ink stick. The side surfaces can be substantially linear from top to bottom, or they can be stepped or segmented, as seen in FIG. 3, which illustrates a front view of the ink sticks of FIG. 2. In embodiments, the ink sticks for the different ink feed channels of a particular printer can be made identically. In other embodiments, such as the embodiments shown in FIG. 2, each color of ink stick can be made to have a particular perimeter shape, as viewed from above the ink stick, different from the perimeter shapes of other colors of ink sticks. The ink stick perimeter shape can be the shape of either the top or the bottom (or both) of the ink stick, or of protruding portions from the sides of the ink stick. In FIG. 2, each ink stick has a face surface 3, a rear surface 4, a first side surface 5, and a second side surface 6. In the embodiment shown in FIG. 2, the face surface 3 and the rear surface 4 have nonplanar contours. Further, the face surface 3 and the rear surface 4 are designed to substantially complement each other so that the sticks nest together in a feed channel.

The perimeter shape as viewed from the top of the ink stick may include features that extend from the side surfaces below the ink stick top surface. Unless stated otherwise, when the term perimeter is used it shall mean the view looking down on the ink stick, as opposed to the perimeter of the top surface of the ink stick.

Ink sticks can have different shapes to distinguish among different ink sticks. In particular, ink sticks can have different outer perimeter shapes to provide differentiation. Different portions of the perimeter of the ink stick can be associated with different differentiation elements.

In embodiments, the contours of at least portions of the face surfaces 3 and the contours of at least portions of the rear surfaces 4 can be used to distinguish the particular printer model in which the ink sticks should be used. In such embodiments, each ink stick in a particular printer model would have the same face surface contour and the same rear surface contour regardless of the color of the ink stick. However, the contours of the face surfaces and rear surfaces of the ink sticks would be different than the contours of the face and rear surfaces of ink sticks in other printer models. When used with complementary insertion openings or receptacles 24 in key plates 18, the contours of the front 3 and 4 rear surfaces help prevent the user from adding the wrong ink sticks to a particular printer.

In embodiments, each color of ink stick 2A–D has its own distinctive shape differentiated from other colors of ink sticks by its side surfaces (5,6). The contour of the first side surface 5 and the contour of the second side surface 6 can be different for each color. When used with complementary insertion openings or receptacles 24 in the key plates 18, the side contours help prevent the user from adding the wrong ink sticks to a particular channel. In embodiments, the front 3 and rear 4 surfaces could also be used to distinguish different colors of ink sticks. Likewise, the side surfaces 5 and 6 could be used for model differentiation. In other embodiments, any combination of the surfaces of the ink sticks can be used for various differentiating functions.

FIGS. 2 and 3 are meant to be exemplary and the particular contours of the face, rear, and side surfaces of the ink sticks and key plates shown in these figures should not be considered limiting. Further, the ink sticks can be any color, but typically will be one of the following four colors: cyan, yellow, magenta, and black. Each color of ink stick will have approximately the same volume as the other colors.

FIG. 4 illustrates the printer 10 with its ink access cover 20 raised. The printer 10 includes an ink load linkage element 30, and an ink stick feed assembly or ink loader 16. In embodiments, key plates 18 are positioned within the printer over a chute 9 divided into multiple feed channels 25. Each of the four ink colors has a dedicated channel for loading, feeding, and melting in the ink loader. The channels 25 guide the solid ink sticks toward melt plates (not shown), located at the opposite end of the channels from the key plate insertion opening. These melt plates melt the ink and feed it into the individual ink color reservoirs within the print head (not shown) of the printer 10. The chute 9 in conjunction with key plates 18 and the melt plates can also provide a housing which can accommodate a single or plurality of ink sticks of each color which is staged and available for melting based on printer demands.

Figure 14:
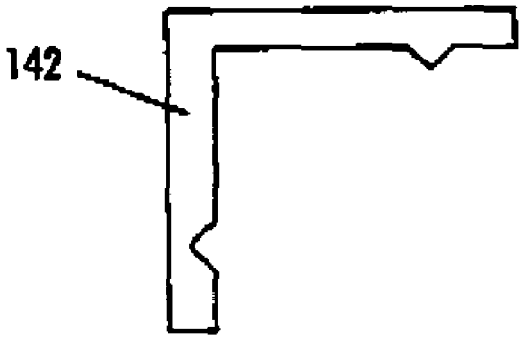
FIG. 14 illustrates an exemplary embodiment of a two-sided insertion opening defining element.
Figure 15:
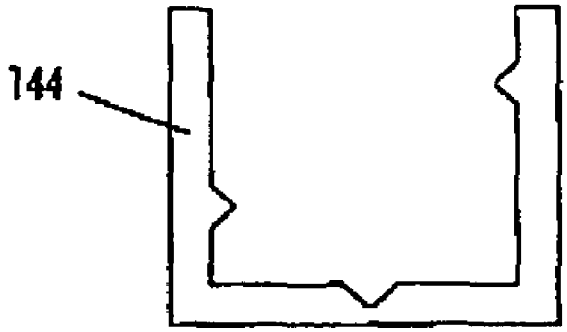
FIG. 15 illustrates an exemplary embodiment of a three-sided insertion opening defining element.

The printer can include either a single key plate, or multiple key plates 18 for different feed channels 25. The key plates 18A–D have receptacles or insertion openings 24 through which ink sticks are inserted into the channels 25 as showing FIGS. 5–6. In embodiments, the ink stick openings 24 in the key plates are defined by separate insertion opening surround elements 21 that are inserted into enlarged key plate receptacles 19 in the key plate(s). Key plates 18 having ink stick insertion opening surround elements 21 offer flexibility in ink loader manufacturing and assemblies. The elements 21 shown in FIGS. 5–6 completely surround and define the insertion openings 24. However, these surround elements are just a subset of the class of insertion elements that could be used. For example, the insertion opening elements could be one, two, or three-sided as shown in FIGS. 12, 14, and 15, respectively.

Each ink stick opening 24 in the key plates 18 corresponds to a particular channel 25 and has a shaped or keyed insertion opening or ink stick receptacle 24 corresponding to a particular ink stick perimeter shape. Ink sticks 2 are inserted into the appropriately shaped openings 24 at the insertion end of each feed channel. Generally, each key plate 18 or insertion opening surround element 21 has an insertion opening 24 having a shape that corresponds to (is keyed to) the perimeter shape of a particular color of ink stick. In embodiments, the openings 24 are shaped to substantially match the perimeter shape of the ink sticks 2 as viewed from the top surface of that ink stick. As noted elsewhere, each color of ink stick 2A–D has differently shaped face, rear, first side, and/or second side features. In embodiments, each keyed opening or receptacle 24 conforms to the top plan view of the ink stick 2. Keying makes accidental mixing of the ink stick colors less probable. The key plate itself, the insert elements 21, or a combination of the two may define the ink stick opening 24 features.

Appropriately keyed insertion openings 18 can contribute to new and improved, customer friendly ink shapes with a family appearance. In embodiments, the openings can have recognizable shapes to facilitate color slot keying.

Figure 5:
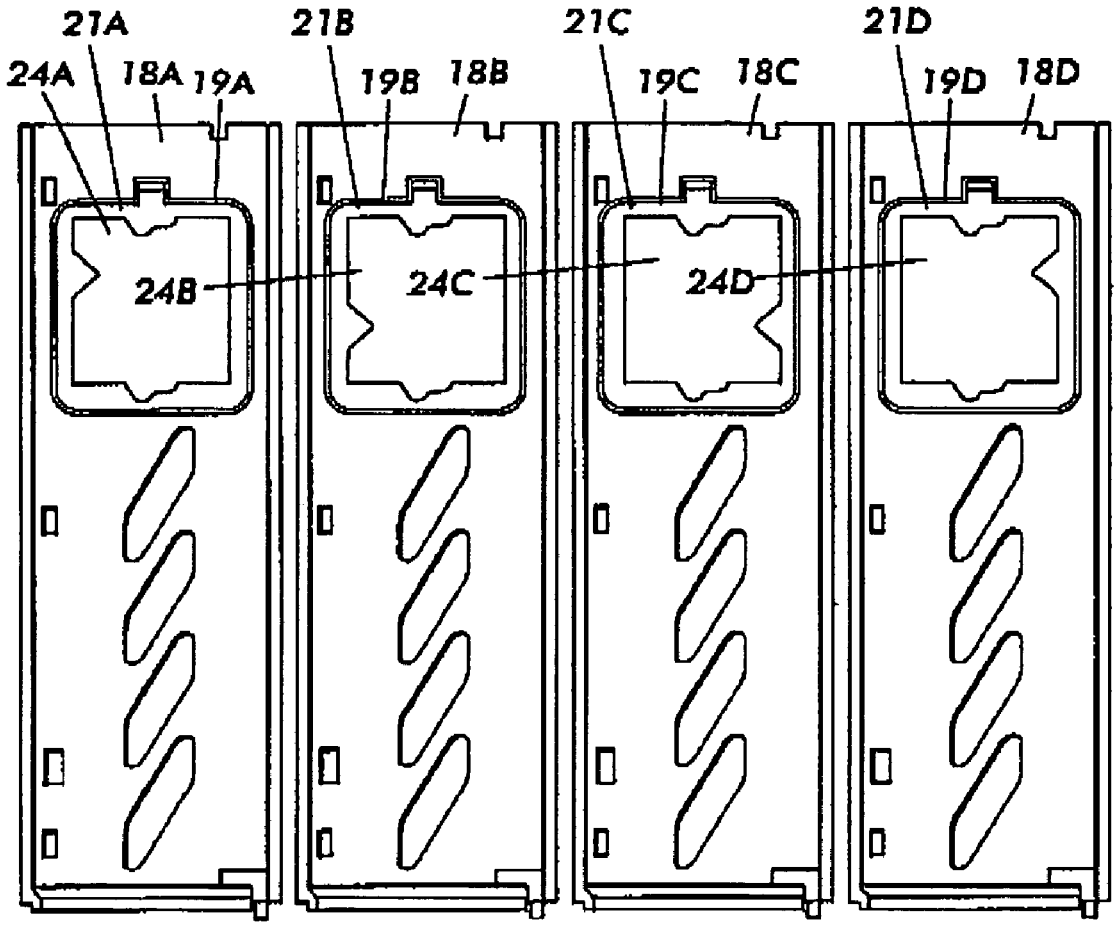
FIG. 5 illustrates a top view of a set of key plates comprising exemplary embodiments of insertion opening defining elements for the printer of FIGS. 1 and 4.
Figure 6:
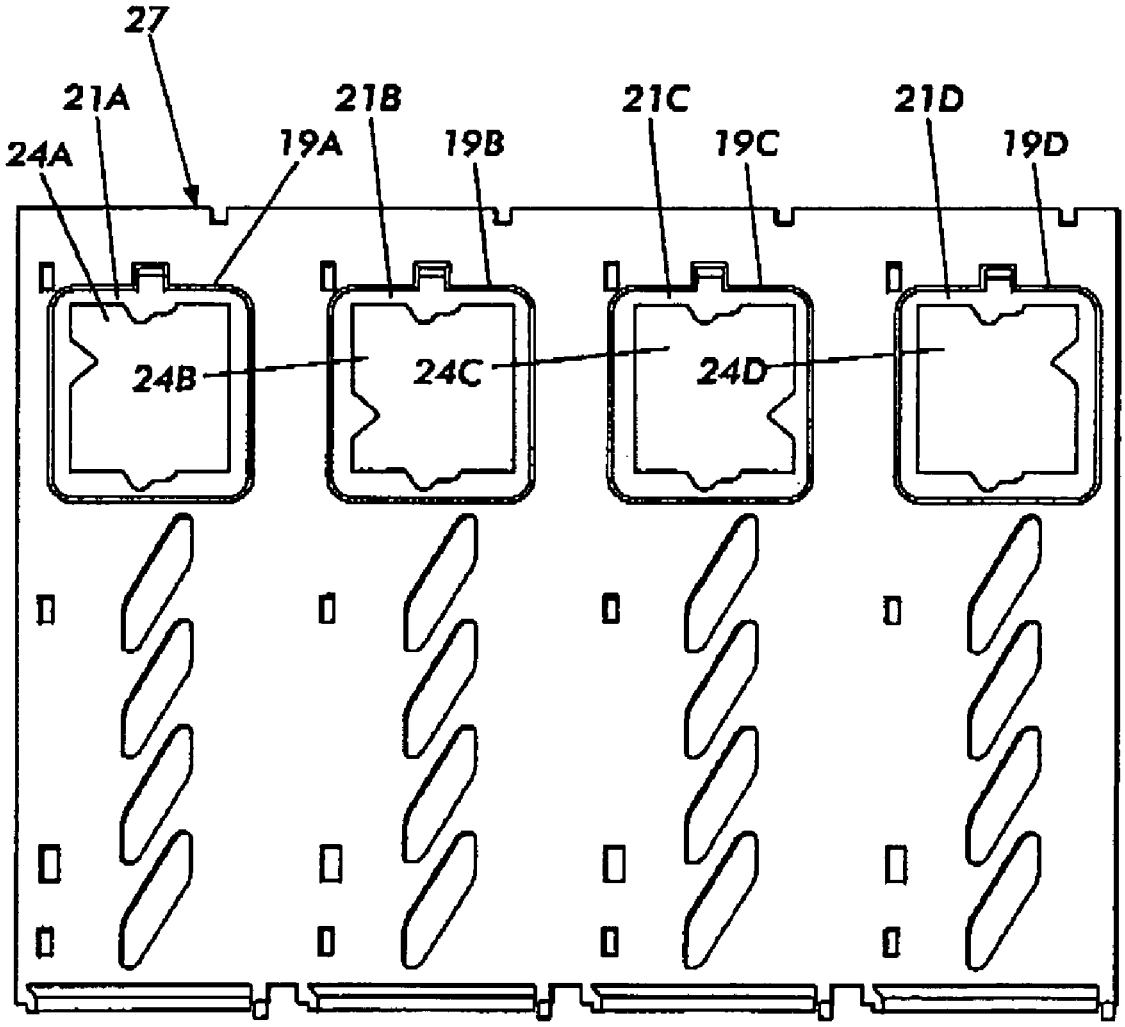
FIG. 6 illustrates a top view of a key plate comprising the exemplary embodiments of insertion opening defining elements for the printer of FIGS. 1 and 4.
Figure 7A:
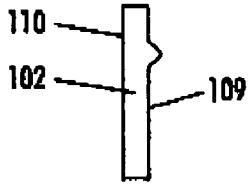
FIG. 7 illustrates more exemplary embodiments of insertion opening defining elements.
Figure 7B:
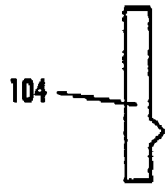
Figure 7C:
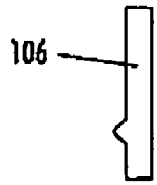
Figure 7D:
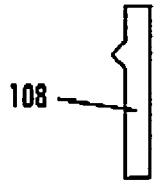
Figure 8A:
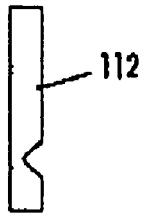
FIG. 8 illustrates more exemplary embodiments of insertion opening defining elements.
Figure 8B:
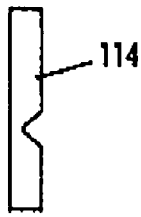
Figure 8C:
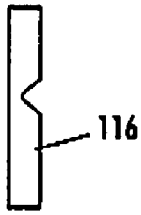
Figure 8D:
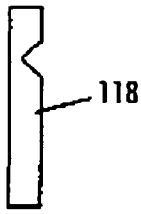

If insert elements are used, the enlarged key plate receptacles for the insertion elements can have a common perimeter shape. In such an embodiment, each insertion opening surround element 21 would have a common outer edge that substantially attaches to at least a portion of the shape of the enlarged key plate receptacles 19. The insertion opening surround elements can be formed with appropriately shaped openings 24 to admit the proper ink sticks into the feed channel. FIGS. 5–6 illustrate multiple and single key plate embodiments using insertion opening surround elements 21.

The surround elements can connect to the key plate receptacles by any of a number of means that are well known in the art. These can include, for example, a simple snap-fit or pressure fit and vibratory welding.

Separate key plates 18 or ink stick insertion opening surround elements 21 offer flexibility in ink loader manufacturing and assemblies. When individual key plates or insertion opening surround elements are used, it is easier for the user to use color matching to indicate which channels carry which color of ink stick. Having individual key plates or insertion opening surround elements provides improved design and manufacturing flexibility and greater assembly options. For example, the use of a new printhead may require a change in the color order of the channels. The same manufactured key plates could be used in a new printer using this design. However, they would just be inserted in a different order. Additionally, a printer can be retrofitted to accommodate differently shaped ink sticks by replacing the individual key plates 18 or individual insertion opening surround elements 21.

Figure 9:
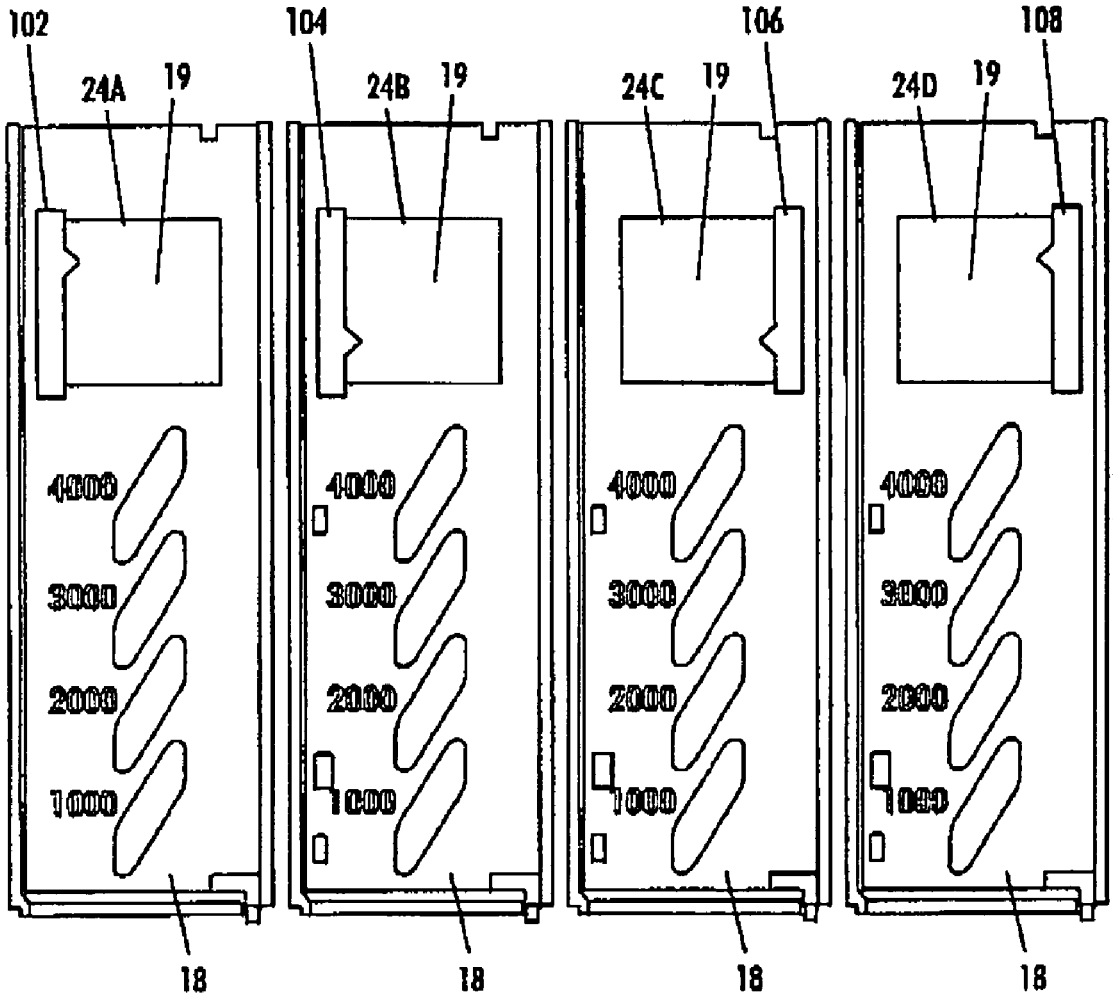
FIG. 9 illustrates an array of key plates including the exemplary embodiments of insertion opening defining elements of FIG. 7.

Insertion opening surround elements 21 do not have to provide a complete perimeter to the insertion openings 24. For example, the elements may provide keying on only one side as illustrated in FIGS. 7A–D and 8A–D. FIGS. 7A–D illustrate a set of four insertion elements 102, 104, 106, 108 that may be used in key plates 18. FIGS. 8A–D illustrate another set of four insertion elements 112, 114, 116, 118 that also may be used in key plates 18. Each of the insertion elements has one edge that is keyed. For example, insertion element 102 has two long edges 109, 110. The relatively straight edge 109 would attach to the perimeter of the key plate receptacle and the keyed edge 110 would partially define the border of the insertion opening 24. See FIG. 9. These elements can connect to the key plate receptacles 19 by any of a number of means that are well known in the art. These include, but are not limited to, a simple snap-fit or pressure fit and vibratory welding.

Figure 10:
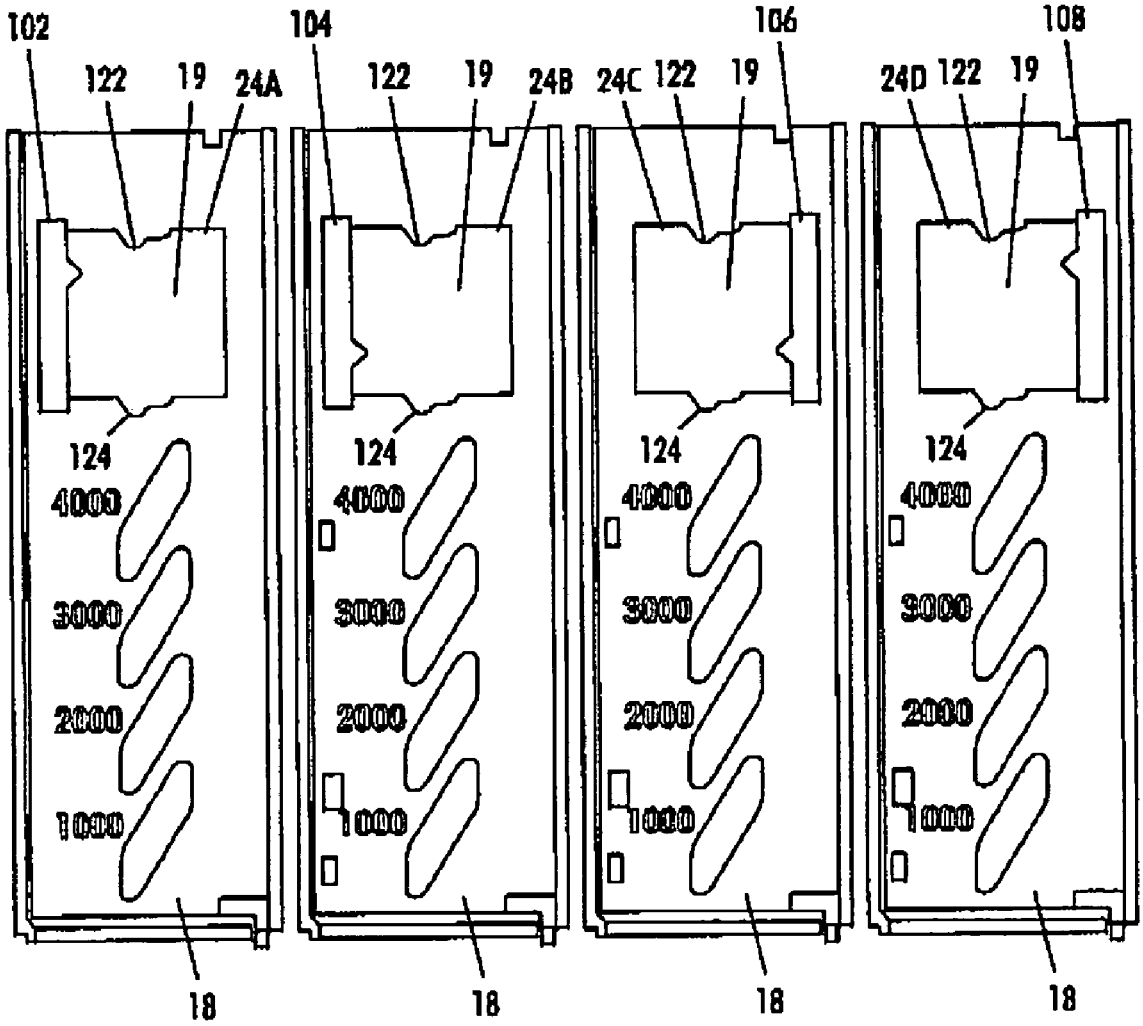
FIG. 10 illustrates a second array of key plates including the exemplary embodiments of insertion opening defining elements of FIG. 7, wherein the key plates comprise keying elements in the ink stick travel direction.
Figure 11:
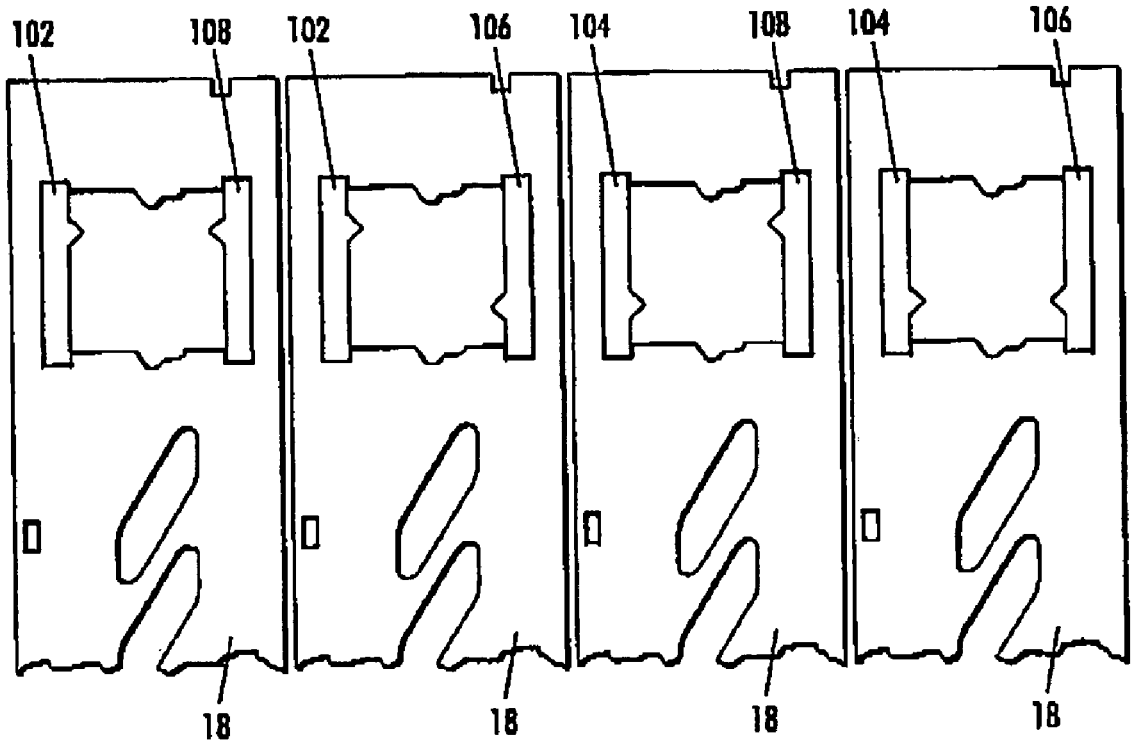
FIG. 11 illustrates a cutaway of an array of key plates including two of the keying elements of FIG. 7.

FIG. 12 illustrates a set of key plates 18, wherein each of the insertion elements 102, 104, 106, 108 shown in FIG. 7 are inserted in the key plates 18A–D. FIG. 10 illustrates a similar embodiment, where the key plates 18A–D themselves also have keying features 122, 124 in the direction of ink stick travel. These particular features 122, 124 are the same for all four. However, keying features 122, 124 could vary from key plate to key plate. FIG. 11 shows four key plates 18, wherein each key plate 18 uses two separate insertion elements. Naturally, this could be extended to three or four sided keying as well.

Note that in the particular examples shown in FIG. 7, depending upon how the insertion elements fit into key plates 18A–D, insertion element 106 may be the same as insertion element 102 rotated 180°, and insertion element 108 may be the same as insertion element 104 rotated 180°. To minimize costs, manufacturing could take advantage of the symmetry of these insertion elements. Alternatively, FIG. 8 illustrates a set of four distinct insertion elements.

Four inserts could, of course, be used to create a complete perimeter. There are a variety of ways to combine the elements shown in FIGS. 7–8. In embodiments, the inserts could all be sized such that their lengths are an insert width smaller than the edge of the receptacle 19 in a key plate 18. This would allow all four to be attached to the receptacle perimeter. Or, they could be sized two different lengths, so that two longer and two shorter segments complete the insertion opening.

Figure 12A:
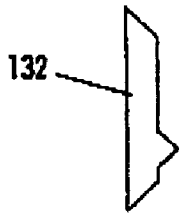
FIG. 12 illustrates exemplary embodiments of insertion opening defining elements having beveled edges.
Figure 12B:
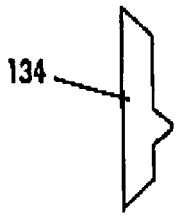
Figure 12C:
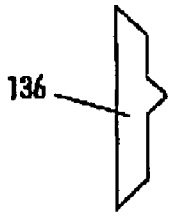
Figure 12D:
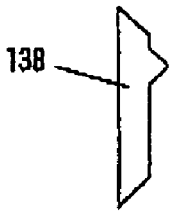
Figure 13:
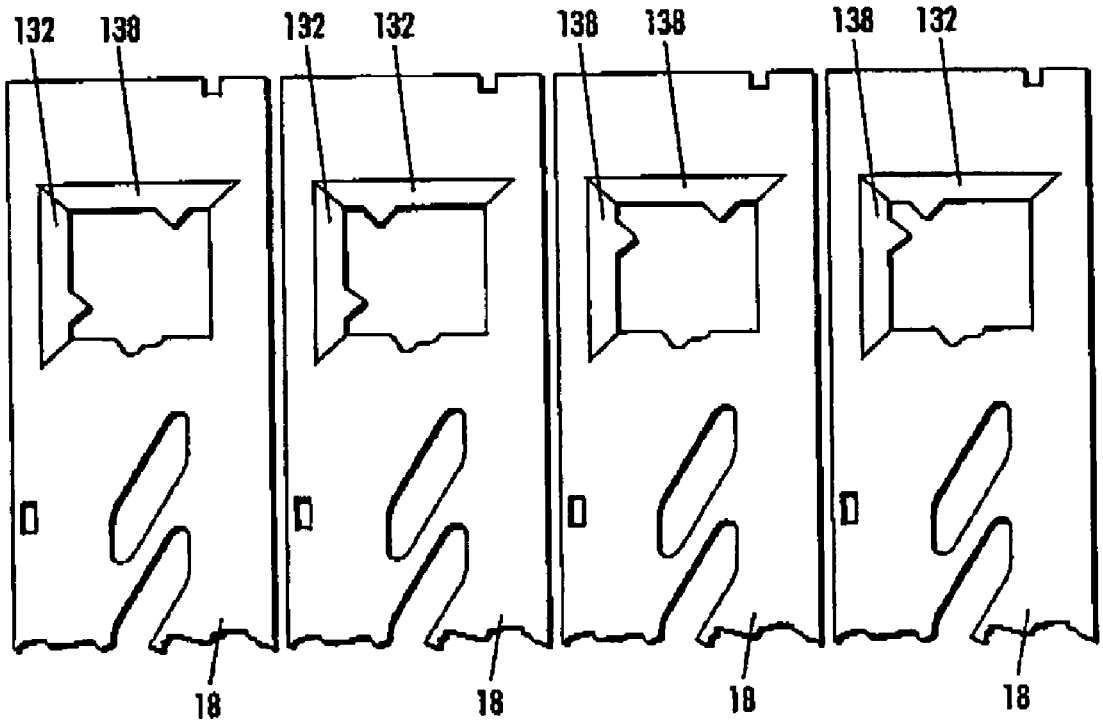
FIG. 13 illustrates a cutaway of an array of key plates including exemplary embodiments of insertion opening defining elements having beveled edges.

In embodiments, to facilitate different combinations of components, the insert elements could have beveled ends, such as the insert elements 132, 134, 136, 138, shown in FIG. 12A–B. This embodiment allows a mixture of uniform length keyed elements to be assembled into partial and complete perimeters. FIG. 13 shows a series of key plates 18 having different combinations of insert elements.

Figure 16:
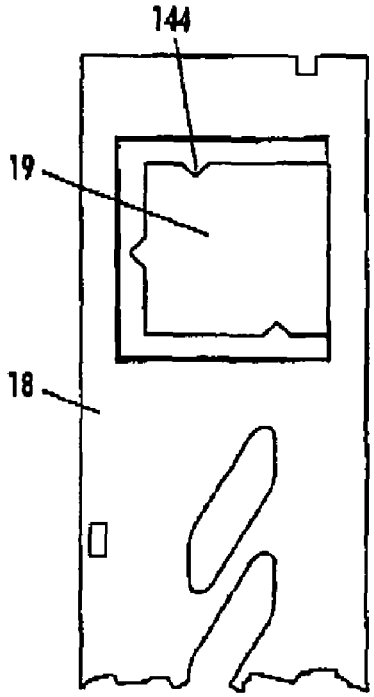
FIG. 16 illustrates a key plate comprising the exemplary embodiment of the three-sided insertion opening defining element of FIG. 15.
Figure 17:
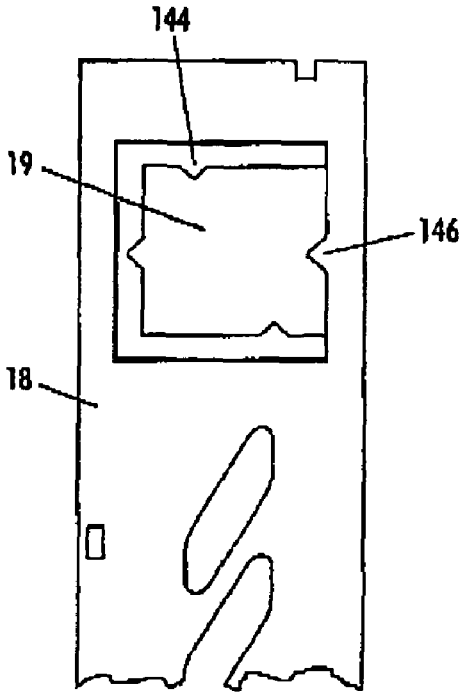
FIG. 17 illustrates a second key plate comprising the exemplary embodiment of the three-sided insertion opening defining element of FIG. 15, wherein the key plate includes a keying feature along a fourth wall of its receptacle.

Further embodiments include two-sided insert elements 142 and three-sided insert elements as illustrated in FIGS. 14–15. FIG. 16 illustrates the three-sided insert 144 from FIG. 15 inserted into a key plate 18. FIG. 17 shows the same insert 144 in a different key plate. The key plate 18 includes a keying element 146 along the edge not covered by the insert 144. Generally, any edges of the receptacle 19 in the key plate can comprise keying features.

While the present invention has been described with reference to specific embodiments thereof, it will be understood that it is not intended to limit the invention to these embodiments. It is intended to encompass alternatives, modifications, and equivalents, including substantial equivalents, similar equivalents, and the like, as may be included within the spirit and scope of the invention. All patent applications, patents and other publications cited herein are incorporated by reference in their entirety.

What is claimed is:

1. A solid ink loader, comprising:

at least one feed channel for receiving ink sticks;

at least one key plate for covering the at least one feed channel, wherein the at least one key plate includes a first receptacle; and a first insertion opening surround element connected to the receptacle that is separate from the first receptacle, wherein the first insertion opening surround element defines a first portion of the perimeter of an ink stick insertion opening and provides keying features along the first portion.

2. The loader of claim 1. wherein the first insertion opening surround element connects to some, but not all, of a border of the receptacle.

3. The loader of claim 2, further comprising a second insertion opening surround element connected to the receptacle, wherein the second insertion opening surround element defines a second portion of the perimeter of the ink stick insertion opening and provides keying features along the second portion.

4. The loader of claim 3, wherein the first insertion opening surround element and the second insertion opening surround element connect to adjacent portions of the receptacle.

5. The loader of claim 3, wherein the first insertion opening surround element and the second insertion opening surround element each have beveled edges.

6. The loader of claim 2, wherein the first insertion opening surround element defines at least two sides of the ink stick insertion opening.

7. The loader of claim 2, wherein the remainder of the border of the receptacle also includes at least one keying feature.

8. The loader of claim 1, wherein the first insertion opening surround element defines an entire perimeter of the ink stick insertion opening.

9. A key plate for use with a solid ink jet printer, the key plate comprising:

a main installation portion having at least one receptacle therein;

a first insertion opening surround portion that connects to at least part of the installation portion, wherein the first insertion opening surround portion defines a first part of an insertion opening in the key plate.

10. The key plate of claim 9, further comprising a second insertion opening surround portion connected to the installation portion, wherein the second insertion opening surround portion defines a second part of an insertion opening.

11. The key plate of claim 10, wherein the first insertion opening surround portion and the second insertion opening surround portion are adjacent each other.

12. The key plate of claim 10, wherein the first insertion opening surround portion and the second insertion opening surround portion each have beveled edges.

13. The key plate of claim 9, wherein the first insertion opening surround portion defines at least two edges of the insertion opening.

14. The key plate of claim 9, wherein the first insertion opening surround element defines an entire perimeter of the ink stick insertion opening.

15. The key plate of claim 9, wherein the remainder of the border of the installation portion also includes at least one keying feature.

16. A first insertion element that connects to an ink stick receptacle in a key plate, wherein the first insertion element forms at least one edge of an insertion opening in the key plate, and wherein the first insertion element is shaped to complement at least a portion of the perimeter of an ink stick.

17. The insertion element of claim 16, wherein the first insertion element connects to some, but not all, of a border of the receptacle.

18. The insertion element of claim 17, wherein the first insertion element is adjacent a second insertion element, wherein the second insertion element is connected to the ink stick receptacle.

19. The insertion element of claim 18, wherein the first insertion element and the second insertion opening element each have beveled edges.

20. The loader of claim 17, wherein the remainder of the border of the receptacle also includes at least one keying feature.

* * * * *